US010196723B2

(12) United States Patent
Aoki et al.

(10) Patent No.: US 10,196,723 B2
(45) Date of Patent: Feb. 5, 2019

(54) PRODUCTION METHOD FOR FE-NI BASED HEAT-RESISTANT SUPERALLOY

(71) Applicant: HITACHI METALS, LTD., Minato-ku, Tokyo (JP)

(72) Inventors: Chuya Aoki, Yasugi (JP); Takehiro Ohno, Yasugi (JP)

(73) Assignee: Hitachi Metals, Ltd., Minato-ku, Tokyo (JP)

( * ) Notice: Subject to any disclaimer, the term of this patent is extended or adjusted under 35 U.S.C. 154(b) by 92 days.

(21) Appl. No.: 15/300,505

(22) PCT Filed: Mar. 18, 2015

(86) PCT No.: PCT/JP2015/057991
§ 371 (c)(1),
(2) Date: Sep. 29, 2016

(87) PCT Pub. No.: WO2015/151808
PCT Pub. Date: Oct. 8, 2015

(65) Prior Publication Data

US 2017/0114435 A1 Apr. 27, 2017

(30) Foreign Application Priority Data

Mar. 31, 2014 (JP) ..... 2014-071422
Sep. 30, 2014 (WO) ..... PCT/JP2014/076054

(51) Int. Cl.
*C22F 1/10* (2006.01)
*C22C 19/05* (2006.01)

(52) U.S. Cl.
CPC ..... *C22F 1/10* (2013.01); *C22C 19/056* (2013.01)

(58) Field of Classification Search
None
See application file for complete search history.

(56) References Cited

U.S. PATENT DOCUMENTS 5,413,752 A * 5/1995 Kissinger ..... B22F 3/24 148/514
6,193,823 B1 2/2001 Morra
(Continued)

FOREIGN PATENT DOCUMENTS

JP 58-061260 A 4/1983
JP 10265878 A 10/1998
(Continued)

OTHER PUBLICATIONS

Office Action Issued by The State Intellectual Property Office of P.R. China for Application No. or Patent No. 201580028247.7 dated Oct. 10, 2017.
(Continued)

*Primary Examiner* — George Wyszomierski
(74) *Attorney, Agent, or Firm* — F. Michael Sajovec; Williams Mullen

(57) ABSTRACT

A production method for an Fe—Ni based heat-resistant superalloy inhibits abnormal grain growth and yields a fine crystal grain structure having an ASTM crystal grain size number of 9 or greater. The production method comprises at least a hot working step in which a material having a prescribed composition is subjected to hot working, wherein the hot working step includes at least a step in which the above material of 930 to 1010° C. is subjected to hot working so that the relation of (effective strain)≥0.139× (effective strain rate(/sec))$^{-0.30}$ is satisfied in the entirety of the above material.

4 Claims, 2 Drawing Sheets

(56) References Cited

U.S. PATENT DOCUMENTS

| | | | | |
|---|---|---|---|---|
| 6,409,853 | B1 * | 6/2002 | Thamboo | B21J 1/06 148/410 |
| 6,496,529 | B1 | 12/2002 | Jones et al. | |
| 2004/0025989 | A1 | 2/2004 | Chiba et al. | |
| 2006/0088411 | A1 * | 4/2006 | Imano | C22C 19/056 415/200 |
| 2012/0037280 | A1 | 2/2012 | Devaux | |

FOREIGN PATENT DOCUMENTS

| | | | |
|---|---|---|---|
| JP | 2001-123257 | A | 5/2001 |
| JP | 2003-226950 | A | 8/2003 |
| JP | 2012-517524 | A | 8/2012 |
| JP | 2013-155431 | A | 8/2013 |
| JP | 2014-161861 | A | 9/2014 |

OTHER PUBLICATIONS

Japanese Patent Office, Office Action regarding Patent Application No. 2015-563012, Dispatch No. 190653, dated Apr. 27, 2016.
Japan Patent Office, International Search Report based on PCT/JP2015/057991, dated Jun. 8, 2015.
European Patent Office, Supplementary European Search Report based on EP 15 77 4234, dated Oct. 11, 2017.

* cited by examiner

PRODUCTION METHOD FOR FE-NI BASED HEAT-RESISTANT SUPERALLOY

RELATED APPLICATIONS

The present application claims priority to Japanese Patent Application No. 2014-071422 filed on Mar. 31, 2014, Japanese Patent Application No. PCT/JP2014/076054 filed on Sep. 30, 2014, and PCT/JP2015/057991 filed on Mar. 18, 2015, the disclosures of which are incorporated by reference in their entireties.

TECHNICAL FIELD

The present invention relates to a production method for an Fe—Ni based heat-resistant superalloy.

BACKGROUND ART

Alloy 718, which is an Fe—Ni based heat-resistant superalloy used in gas turbine parts for aircraft and power generation, has been widely used for its excellent mechanical properties. In particular, a high fatigue strength is required for large rotating parts in jet engines and gas turbines. Accordingly, Alloy 718 used for such parts is required to have a further enhanced fatigue strength by evenly micronizing grains. For evenly micronizing grains, a billet is often prepared from an ingot of Alloy 718 and then subjected to hot working in a temperature range of 930 to 1010° C. by making use of the pinning effect of the delta phase to form a fine recrystallized structure, and the billet is then subjected to solution treatment (solid solution heat treatment) and aging, or directly to aging.

However, when carrying out hot working under low strain conditions by, for example, closed die forging or ring rolling, abnormal grain growth (hereinafter referred to as AGG) may occur and grains are rapidly coarsened beyond the pinning of the delta phase during the hot working, cooling after the hot working, or solution treatment after the hot working. When such AGG occurs as shown in FIG. 2, a uniform fine structure is broken, and therefore the fatigue characteristic deteriorates. According to Patent Document 1, an influential factor for preventing AGG is identified and a strain of 0.125 or higher is applied in the entirety of the part so as to avoid AGG.

CITATION LIST

Patent Document

Patent Document 1: JP 2001-123257 A

SUMMARY OF INVENTION

Technical Problems to Solve

When Alloy 718 is used for parts in which fatigue strength is important, it is necessary to regulate the structure of the alloy to have a uniform and very fine crystal grain structure having an ASTM crystal grain size number of 9 or more. The technology described in Patent Document 1 is excellent in terms of making it possible to avoid AGG occurrence during the subsequent solution treatment when the entirety of the part of Alloy 718 is provided with a strain of 0.125 or higher under low strain conditions during the hot forging step. The hot working includes, for example, closed die forging and ring rolling, and Alloy 718 is provided with strain at various strain rates in such working processes. For example, when providing Alloy 718 with a strain of about 0.125 under the low strain rate condition, Alloy 718 may often be subjected to hot working in an area in which AGG still occurs, and a fine crystal grain structure may not be obtained. This problem becomes marked particularly when Alloy 718 is used for large-sized forged articles and ring-rolled articles which are subjected to closed die forging or ring rolling.

An object of the present invention is to provide a production method for an Fe—Ni based heat-resistant superalloy in which AGG is inhibited and in which a fine crystal grain structure having an ASTM crystal grain size number of 9 or higher is provided.

Means for Solving the Problem

The present invention has been made in light of the problem described above. The present invention relates to a production method for an Fe—Ni based heat-resistant superalloy having a composition comprising 0.08% by mass or less of C, 0.35% by mass or less of Si, 0.35% by mass or less of Mn, 0.015% by mass or less of P, 0.015% by mass or less of S, 50.0 to 55.0% by mass of Ni, 17.0 to 21.0% by mass of Cr, 2.8 to 3.3% by mass of Mo, 1.0% by mass or less of Co, 0.30% by mass or less of Cu, 0.20 to 0.80% by mass of Al, 0.65 to 1.15% by mass of Ti, 4.75 to 5.50% by mass of Nb+Ta, 0.006% by mass or less of B, and the balance of Fe and unavoidable impurities, the production method comprising at least a hot working step in which a material having the composition described above is subjected to hot working, wherein the hot working step described above comprises at least a step in which the above material of 930 to 1010° C. is subjected to hot working so that a relation of (effective strain)≥0.139×(effective strain rate(sec))$^{-0.30}$ is satisfied in the entirety of the material.

Also, the production method for an Fe—Ni based heat-resistant superalloy according to the present invention may comprise a solution treatment step in which the material is subjected to the solution treatment for 0.5 to 10 hours in a range of 950 to 1000° C.

Further, the production method for an Fe—Ni based heat-resistant superalloy according to the present invention may comprise a heat treatment step in which the material is subjected to heat treatment for 5 to 60 hours in a range of 600 to 930° C. after the hot working step and before the solution treatment step.

The production method for an Fe—Ni based heat-resistant superalloy according to the present invention may comprise as well a first aging treatment step in which the material is subjected to the first aging treatment for 2 to 20 hours in a range of 700 to 750° C. after the solution treatment step.

In addition, the production method for an Fe—Ni based heat-resistant superalloy according to the present invention may comprise a second aging treatment step in which the material is subjected to the second aging treatment for 2 to 20 hours in a range of 600 to 650° C. after the first aging treatment step.

Advantages

According to the present invention, AGG of an Fe—Ni based heat-resistant superalloy can be avoided, and a uniform and fine crystal grain structure having an ASTM crystal grain size number of 9 or more can be obtained. Jet engine and gas turbine members and the like prepared by using the above Fe—Ni based heat-resistant superalloy can be enhanced in reliability of a fatigue property.

DESCRIPTION OF EMBODIMENTS

Figure 1:
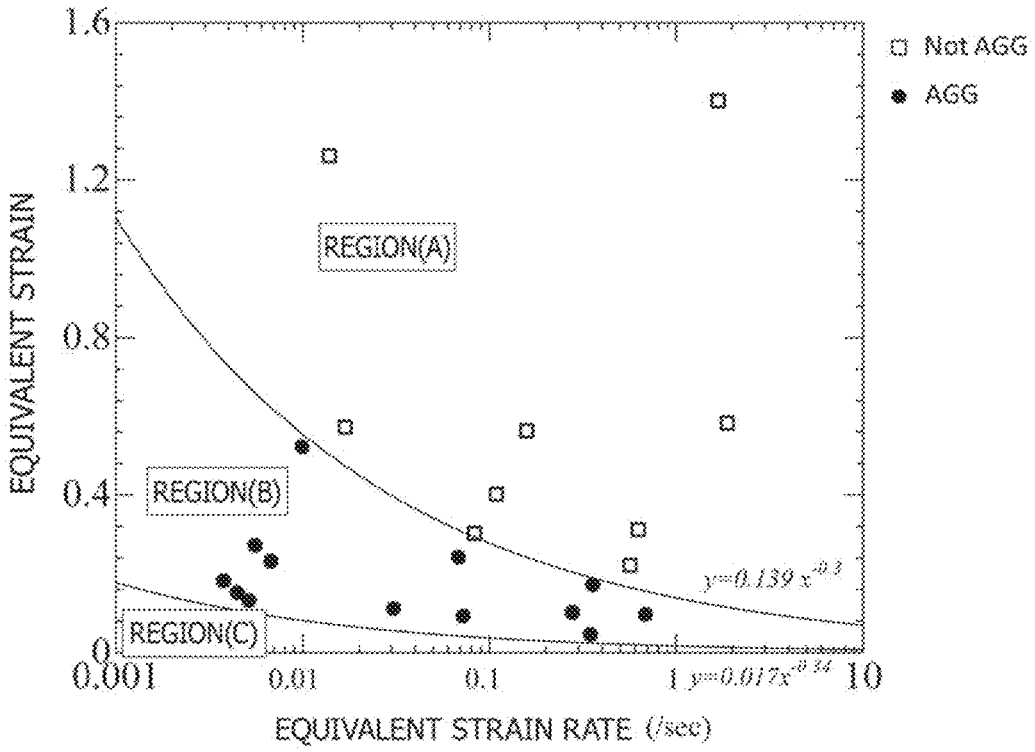
FIG. 1 is a drawing showing a relation of metal structures influenced by a relation of an effective strain and an effective strain rate.
Figure 2:
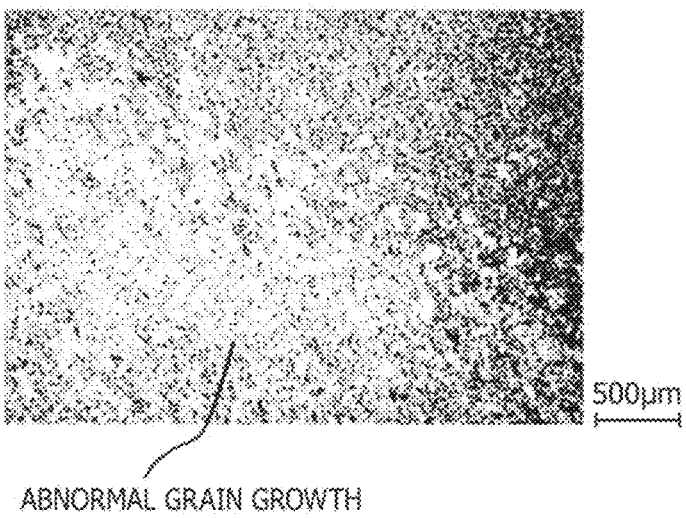
FIG. 2 is a metal structure photograph of abnormal grain growth.

The production method for an Fe—Ni based heat-resistant superalloy according to the present invention will be discussed in detail below. The present invention, however, is by no means limited by examples explained below.

The present invention comprises at least a hot working step in which the material of the Fe—Ni based heat-resistant superalloy having a prescribed alloy composition is subjected to hot working. In the hot working step such as hot forging and the like, abnormal grain growth is prevented by optimizing hot working conditions against various strain rates in closed die forging, ring rolling and the like. The specific examples of the hot working step will be explained below.

The alloy composition of the Fe—Ni based heat-resistant superalloy prescribed in the present invention is known as that of an NCF718 alloy (Fe—Ni based heat-resistant superalloy) according to JIS-G4901, and therefore, detailed explanations on the composition are omitted. In this connection, the term "4.75 to 5.50% by mass of Nb+Ta" means that Nb and Ta are present 4.75 to 5.50% by mass in total in the composition of the Fe—Ni based heat-resistant superalloy.

Hot Working Step

In order to obtain the Fe—Ni based heat-resistant superalloy having a fine crystal grain structure, the material of the Fe—Ni based heat-resistant superalloy is subjected to hot working in a temperature range of 930 to 1010° C. Use of the material in the above temperature range makes it possible to accelerate recrystallization during the hot working such as hot forging and the like. If the temperature of the material described above before the hot working is lower than 930° C., the material is hardly recrystallized during the hot working. On the other hand, if the temperature of the material before the hot working exceeds 1010° C., the recrystallization of the material is accelerated during the hot working, but the resulting recrystallized grains become larger in size, so that it becomes difficult to obtain fine grains. The recrystallization of fine crystals can be accelerated by controlling the temperature of the material before the hot working at 930 to 1010° C., preferably 950 to 1000° C. The Fe—Ni based heat-resistant superalloy may be heated to a temperature of 930 to 1010° C., for example, prior to the hot working.

According to the present invention, the condition of the hot working is to satisfy the relation of (effective strain)≥0.139×(effective strain rate(sec))$^{-0.30}$ in the entirety of the above material of the Fe—Ni based heat-resistant superalloy in a temperature range of 930 to 1010° C. The above relational equation is applied to an effective strain of 5 or less and an effective strain rate of 0.0001 to 10/second which are assumed in the hot working such as ring milling in addition to hot forging including closed die forging, hot die forging and isothermal forging. The upper limit of the effective strain is preferably 4, more preferably 3.5. The lower limit of the effective strain rate is preferably 0.001/second, more preferably 0.005/second. The upper limit of the effective strain rate is preferably 5/second, more preferably 1/second. The effective strain and effective strain rate respectively represent a strain and a strain rate obtained by converting vertical and shearing strains of six-axis elements into single axis.

Abnormal grain growth (AGG) occurs when a crystal grain size before the hot working is about 8 or higher in terms of the grain size number as determined in accordance with ASTM, and if the initial grains are finer, the sensitivity tends to increase. According to the investigations by the present inventors, if the strain rate is smaller, range (B) in which AGG occurs tends to expand as shown in FIG. 1. This tendency is attributable to the fact that strain is accumulated again in dynamic recrystallization that is brought about, for example, during closed die forging under a low strain rate condition, so that a crystal grain boundary shifts during the solution treatment using the stored energy of the grain boundary as a driving force. On the other hand, in the low strain region (C) satisfying the following equation, AGG can usually be prevented.

$$\text{(effective strain)} \leq 0.017 \times \text{(effective strain rate(/sec))}^{-0.34} \quad \text{[Equation 1]}$$

This region (C), however, corresponds to a dead zone during the hot working, and therefore the grains are not expected to be refined or made finer by recrystallization. On the other hand, in region (A), the grains can be refined by recrystallization, and AGG can be prevented as well. If regions (A) and (C) are present in a mixed manner during the hot working, region (B), in which AGG would occur, is also present. The relational equation of region (B) is shown below.

$$0.017 \times \text{(effective strain rate(/sec))}^{-0.34} < \text{(effective strain)} < 0.139 \times \text{(effective strain rate(/sec))}^{-0.30} \quad \text{[Equation 2]}$$

According to the present invention, a suitable strain is applied to the entirety of the material during hot working in region (A) under the condition that the following relational equation is satisfied so as to avoid AGG occurrence.

$$\text{(effective strain)} \geq 0.139 \times \text{(effective strain rate(/sec))}^{-0.30} \quad \text{[Equation 3]}$$

The relational equations showing regions (A) to (C) have been obtained by observing the structures and calculating relationships between effective strains and effective strain rates in which AGG occurs using multiple linear regression analysis.

In the production method for the Fe—Ni based heat-resistant superalloy according to the present invention, solution treatment can be carried out after the hot working step described above. Also, prior to the solution treatment, a heat treatment step in which the alloy described above is heated for preliminary heating can be carried out. Then, a first aging treatment can be carried out after the solution treatment. Further, a second aging treatment can be carried out following the first aging treatment. The specific examples of the above treatments will be described below.

Heat Treatment Step

It is a step in which the Fe—Ni based heat-resistant superalloy cooled by air or the like after the hot working step described above is subjected to heat treatment for 5 to 60 hours in a temperature range of 600 to 930° C. for preheating before being subjected to the solution treatment. This heat treatment step makes it possible to further reduce the risk of having AGG during the solution treatment carried out subsequently at 950 to 1000° C.

For preventing AGG occurrence, it is useful to allow little strain energy to remain accumulated in grain boundaries at the time of finishing the hot forging. If the strain rate is smaller, the strain energy tends to accumulate in the crystal grain boundaries, and therefore it is difficult to completely remove the accumulated strain energy. Accordingly, the superalloy is subjected preferably to the heat treatment step as a preliminary heating treatment prior to the solution treatment so as to remove the accumulated strain energy as much as possible.

The accumulated strain energy is removed during the pre-heating treatment by proactively precipitating depositions. That is, the gamma double prime (γ") and gamma prime (γ') phases which contribute to enhancing the strength are precipitated in a temperature range of 600 to 800° C., and a delta phase is precipitated in a temperature range of 800 to 930° C. The above pre-heating treatment can be carried out in two stages in which a first-stage pre-heating treatment is carried out by holding the alloy at a specific temperature for a fixed period of time to precipitate gamma double prime and gamma prime and a second-stage pre-heating treatment is then carried out by heating the alloy up to a specific temperature and holding it for a fixed period of time to precipitate the delta phase. Also, the heat treatment may be carried out by heating the alloy, for example, from 600° C. gradually up to 930° C. without holding it at specific temperatures for a fixed period of time. However, if the pre-heating treatment temperature is lower than 600° C., the gamma double prime phase and the gamma prime phase are not expected to precipitate. On the other hand, if the pre-heating treatment temperature exceeds 930° C., the grains are likely to grow before removing the accumulated strain energy. Also, if the time for the pre-heating treatment is shorter than 5 hours, removal of the accumulated strain energy described above and the effect of precipitating the depositions may be unsatisfactory in certain cases. On the other hand, if the time for the pre-heating treatment exceeds 60 hours, the effects may not be enhanced any further. Accordingly, the conditions for the pre-heating treatment prior to the solution treatment are preferably a temperature range of 600 to 930° C. and a time period of 5 to 60 hours. The lower limit of the pre-heating treatment temperature is preferably 650° C., and more preferably 700° C. The upper limit of the pre-heating treatment temperature is preferably 920° C., more preferably 910° C. Also, the lower limit of the pre-heating treatment time is preferably 7 hours, more preferably 10 hours. The upper limit of the pre-heating treatment time is preferably 50 hours, more preferably 40 hours.

Solution Treatment Step

The heating temperature during the solution treatment is important for maintaining the fine recrystallized structure obtained in the hot working step. If the heating temperature in the solution treatment is lower than 950° C., the delta phase is deposited in excess during the solution treatment, and therefore, the amount of the gamma double prime phase deposited in the subsequent aging treatment decreases and results in an overall reduction in the strength. On the other hand, if the solution treatment temperature exceeds 1000° C., the pinning effect of the delta phase reduces, and as a result, the grains grow to reduce tensile and fatigue strengths. Accordingly, the solution treatment temperature is set to 950 to 1000° C. It is preferably 950 to 990° C.

Also, the holding time for the solution treatment is set to 0.5 to 10 hours. If it is shorter than 0.5 hours, compounds deposited during cooling after finishing the hot working may reduce solid solution effects. On the other hand, treatment carried out for a time exceeding 10 hours is not economical and likely to bring about the growth of the fine grains. It is preferably 1 to 3 hours.

Aging Treatment Step

A first aging treatment may be carried out by holding the Fe—Ni based heat-resistant superalloy, which has been subjected to the solution treatment, at 700 to 750° C. for 2 to 20 hours and then cooled down to 600 to 650° C., and a second aging treatment may then be carried out by holding the superalloy at 600 to 650° C. for 2 to 20 hours.

An object of the aging treatment is to finely precipitate the gamma prime phase and the gamma double prime phase which are precipitation strengthening phases to obtain high strength at high temperatures. It takes too long in certain cases to precipitate the precipitation strengthening phases only by the second aging treatment which is carried out at a lower temperature, and therefore, the aging treatment is carried out at a higher temperature as the first aging treatment to thereby make it possible to accelerate the precipitation of the gamma prime and gamma double prime phases.

When the treatment temperature of the first aging treatment is lower than 700° C., the acceleration of precipitation is insufficient, and thus, the effect of enhancing the precipitation is reduced. On the other hand, if the treatment temperature of the first aging treatment exceeds 750° C., the precipitation is further accelerated, but not only the precipitated grains are increased in size to reduce the effect of enhancing the precipitation, but also the gamma double prime phase may be transformed into the delta phase which shows no precipitation enhancement capability in some cases. Accordingly, the treatment temperature of the first aging treatment is set to a temperature range of 700 to 750° C. It may be preferably 710 to 730° C.

Also, if the holding time of the treatment temperature during the first aging treatment is shorter than 2 hours, the precipitation of the gamma prime and gamma double prime phases may be insufficient. On the other hand, if the foregoing holding time of the first aging treatment exceeds 20 hours, the precipitation of the gamma prime and gamma double prime phases may be saturated, and therefore, it may not be economical. Accordingly, the foregoing holding time of the first aging treatment is set to a range of 2 to 20 hours. It may preferably be 4 to 15 hours.

The second aging treatment is carried out after the first aging treatment described above. If the treatment temperature of the second aging treatment is lower than 600° C., it takes too long in certain cases to precipitate the gamma prime and gamma double prime phases, and therefore, it is not efficient. Also, if the treatment temperature of the second aging treatment exceeds 650° C., a difference in temperature from the first aging treatment is small, and therefore, the driving force for the precipitation may be insufficient in reducing the amount of precipitation. Accordingly, the treatment temperature of the second aging treatment is set to a temperature range of 600 to 650° C. It may preferably be 610 to 630° C. The holding time of the treatment temperature during the second aging treatment is set to 2 to 20 hours for the same reasons as described above for the first aging treatment. It may preferably be 4 to 15 hours.

EXAMPLES

The present invention shall be explained below more specifically with reference to examples, but the present invention shall by no means be restricted to the following examples.

Example 1

Figure 3:
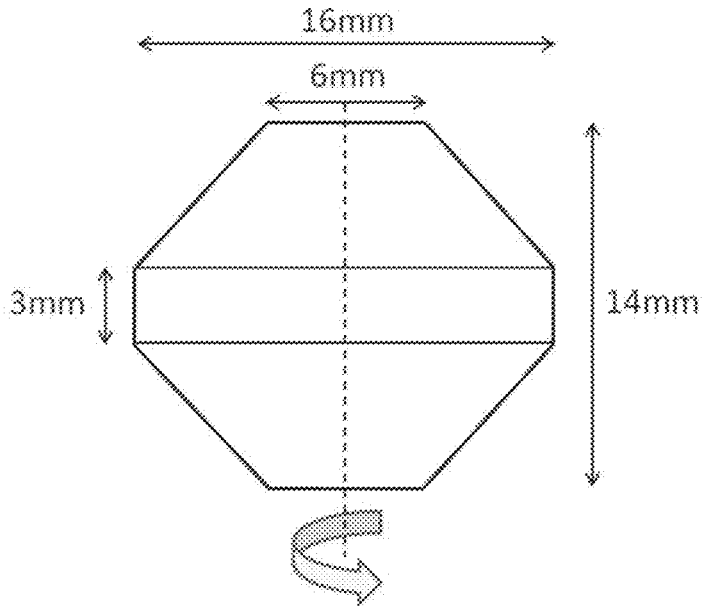
FIG. 3 is a side schematic drawing of a small compression test piece.

A billet having a chemical composition shown in Table 1 which corresponded to that of an Fe—Ni based heat-resistant superalloy (Alloy 718) was used and was subjected to upset forging in a temperature range of 950 to 1000° C., and then it was subjected to ring rolling in a temperature range of 950 to 1000° C. Next, the hot alloy described above was held at 980° C. for 1 hour in order to remove strain remaining in the alloy, and then it was cooled down to room temperature by air so as to prepare a small compression test piece shown in FIG. 3 and subject it to a hot working test. This small compression test piece was used as a sample material and subjected to the hot working test for investigating factors affecting the occurrence of AGG. The sample material had a crystal grain size of 10 in terms of an average crystal grain size number defined in ASTM-E112.

TABLE 1

| | |
|---|---|
| C | 0.023 |
| Si | 0.07 |
| Mn | 0.11 |
| P | 0.004 |
| S | 0.0002 |
| Ni | 54.9 |
| Cr | 17.97 |
| Mo | 2.98 |
| Co | 0.17 |
| Cu | 0.04 |
| Al | 0.48 |
| Ti | 0.95 |
| Nb + Ta | 5.44 |
| B | 0.0029 |
| Balance | Fe and unavoidable impurities |

(mass %)]

In regard to a factor to cause AGG, the influences of a strain and a strain rate were investigated.

The compression test was carried out at the heating temperature of 980° C., with the rolling reduction of 10 to 50%, the nominal strain rate of 0.005 to 0.5/second which was calculated from the compression rate of the height of the test piece before the compression, and the cooling rate of 540° C./minute after the compression.

Then, the test piece was subjected to solution treatment at 980° C. for 1 hour, and the structure of a vertical cross section thereof was observed under an optical microscope. The effective strain and effective strain rate in a part where the structure was observed were determined by reproducing the hot working test using a commercial forging analysis software DEFORM. AGG was judged to have occurred when the crystal grain size number after the solution treatment was less than 9. The compression test conditions, the crystal grain size number (ASTM) and the judging results of AGG are shown in Table 2.

TABLE 2

| Rolling reduction | Nominal strain rate | Effective strain | Effective strain rate | ASTM# | AGG judgment |
|---|---|---|---|---|---|
| 10% | 0.005/sec | 0.13 | 0.0052/sec | #5 | AGG |
| 30% | 0.005/sec | 0.15 | 0.0045/sec | #5 | AGG |
| 30% | 0.005/sec | 0.23 | 0.0068/sec | #7.5 | AGG |

TABLE 2-continued

| Rolling reduction | Nominal strain rate | Effective strain | Effective strain rate | ASTM# | AGG judgment |
|---|---|---|---|---|---|
| 50% | 0.005/sec | 0.18 | 0.0038/sec | #5 | AGG |
| 50% | 0.005/sec | 0.27 | 0.0056/sec | #7 | AGG |
| 50% | 0.005/sec | 0.52 | 0.010/sec | #8 | AGG |
| 10% | 0.05/sec | 0.091 | 0.073/sec | #5.5 | AGG |
| 30% | 0.05/sec | 0.11 | 0.031/sec | #6 | AGG |
| 30% | 0.05/sec | 0.24 | 0.069/sec | #8.5 | AGG |
| 10% | 0.5/sec | 0.044 | 0.35/sec | #5.5 | AGG |
| 10% | 0.5/sec | 0.095 | 0.69/sec | #8 | AGG |
| 30% | 0.5/sec | 0.10 | 0.28/sec | #7 | AGG |
| 50% | 0.5/sec | 0.17 | 0.36/sec | #8.5 | AGG |
| 30% | 0.005/sec | 0.57 | 0.017/sec | #9 | No AGG |
| 50% | 0.005/sec | 1.26 | 0.014/sec | #9 | No AGG |
| 30% | 0.05/sec | 0.30 | 0.084/sec | #9.5 | No AGG |
| 30% | 0.05/sec | 0.40 | 0.11/sec | #10 | No AGG |
| 30% | 0.05/sec | 0.56 | 0.16/sec | #10.5 | No AGG |
| 30% | 0.5/sec | 0.22 | 0.57/sec | #9.5 | No AGG |
| 30% | 0.5/sec | 0.58 | 1.9/sec | #11 | No AGG |
| 50% | 0.5/sec | 0.31 | 0.63/sec | #10.5 | No AGG |
| 50% | 0.5/sec | 1.4 | 1.7/sec | #11.5 | No AGG |

From the results shown in Table 2 above, the relationship among metal structures was clarified which is influenced by the relationship between the effective strain and the effective strain rate shown in FIG. 1. In FIG. 1, AGG did not occur in regions (A) and (C), and AGG occurred in region (B). In region (A), the grains can be micronized by recrystallization, and AGG could be prevented as well. Region (C) corresponds to a dead zone during hot working, and the grains cannot be expected to be micronized by recrystallization in region (C).

As shown in FIG. 1, it was found that if the effective strain is smaller, region (B) increases in width, so that the range of the effective strain with which AGG occurred increased. The following relational equation between the effective strain and the effective strain rate for which AGG can be avoided was obtained from the results shown in FIG. 1. The following relational equation is satisfied in region (A) shown in FIG. 1, and it was confirmed that the AGG occurrence can be prevented by carrying out the hot working in region (A).

$$(\text{effective strain}) \geq 0.139 \times (\text{effective strain rate}(/\text{sec}))^{-0.30} \quad \text{[Equation 4]}$$

Example 2

An 800 kg amount of material for hot working which comprises an Fe—Ni based heat-resistant superalloy (718 alloy) having the chemical composition shown in Table 1 was used and subjected to hot forging. The hot working material was subjected to hot forging in a temperature range of 980 to 1000° C. so that the effective strain satisfies the relation of the following equation in the entirety of the hot working material.

After the hot forging, the material was subjected to pre-heating and solution treatment for the six different conditions of (a) to (0 shown in Table 3 for the purpose of inhibiting the growth of grains during the solution treatment as much as possible, and then it was subjected to the first aging treatment at 718° C. for 8 hours and the second aging treatment at 621° C. for 8 hours.

$$(\text{effective strain}) \geq 0.139 \times (\text{effective strain rate}(/\text{sec}))^{-0.30} \quad \text{[Equation. 5]}$$

TABLE 3

| | Pre-heating | Solution treatment | Remarks |
|---|---|---|---|
| (a) | — | 982° C. × 1 hr Air cooling | Present invention (ordinary solution treatment) |
| (b) | 720° C. × 8 hr → 900° C. × 4 hr | 982° C. × 1 hr Air cooling | Present invention |
| (c) | 720° C. × 8 hr → 900 × 8 hr | 982° C. × 1 hr Air cooling | Present invention |
| (d) | 720° C. × 8 hr → 900 × 24 hr | 982° C. × 1 hr Air cooling | Present invention |
| (e) | 900° C. × 24 hr | 982° C. × 1 hr Air cooling | Present invention |
| (f) | 900° C. × 48 hr | 982° C. × 1 hr Air cooling | Present invention |

Shown in Table 4 are results obtained by measuring the crystal grain sizes of a sample subjected to the hot forging without being subjected to the solution treatment and samples subjected to the solution treatment. Even when a sample was subjected to the ordinary solution treatment without being subjected to the pre-heating, it was provided with a crystal grain size of 9 or larger (condition (a)). It was found that the growth of grains was strongly inhibited for heat treatment conditions (b) to (f) including the pre-heating as compared with the ordinary solution treatment condition (a). Also, conditions (b), (c) and (d) under which the material was subjected to two-stage heating at 720° C. and 900° C. were most effective among conditions (b) to (f) which involve pre-heating.

TABLE 4

| Heat treatment condition | ASTM# | AGG determination |
|---|---|---|
| Forging alone | #10.5-11 | No AGG |
| (a) | #9-9.5 | No AGG |
| (b) | #10.5 | No AGG |
| (c) | #10.5 | No AGG |
| (d) | #10.5 | No AGG |
| (e) | #9.5-10 | No AGG |
| (f) | #9.5-10 | No AGG |

As explained above, it was found that by applying the production method of the present invention AGG is inhibited in an Fe—Ni based heat-resistant superalloy and a fine crystal grain structure is obtained having an ASTM crystal grain size number of 9 or greater. The reliability of the fatigue characteristics of parts for jet engines and gas turbines and the like can be improved.

The invention claimed is:

1. A production method for an Fe—Ni based heat-resistant superalloy having a composition comprising 0.08% by mass or less of C, 0.35% by mass or less of Si, 0.35% by mass or less of Mn, 0.015% by mass or less of P, 0.015% by mass or less of S, 50.0 to 55.0% by mass of Ni, 17.0 to 21.0% by mass of Cr, 2.8 to 3.3% by mass of Mo, 1.0% by mass or less of Co, 0.30% by mass or less of Cu, 0.20 to 0.80% by mass of Al, 0.65 to 1.15% by mass of Ti, 4.75 to 5.50% by mass of Nb+Ta, 0.006% by mass or less of B, and the balance of Fe and unavoidable impurities, the production method comprising a) a hot working step comprising subjecting the above material to hot working at 930 to 1010° C. so that a relation of (effective strain)≥0.139×(effective strain rate (/sec))$^{-0.30}$ is satisfied in an entirety of the above material; and b) a solution treatment step in which the material is subjected to solution treatment for 0.5 to 10 hours at a range of 950 to 1000° C. after the hot working step to provide Fe—Ni based heat-resistant superalloy having an ASTM crystal grain size number of 9 or higher.

2. The production method for an Fe—Ni based heat-resistant superalloy according to claim 1, further comprising a heat treatment step in which the material is subjected to heat treatment for 5 to 60 hours in a range of 600 to 930° C. after the hot working step and before the solution treatment step.

3. The production method for an Fe—Ni based heat-resistant superalloy according to claim 2, further comprising a first aging treatment step in which the material is subjected to a first aging treatment for 2 to 20 hours at a range of 700 to 750° C. after the solution treatment step.

4. The production method for an Fe—Ni based heat-resistant superalloy according to claim 3, further comprising a second aging treatment step in which the material is subjected to a second aging treatment for 2 to 20 hours in a range of 600 to 650° C. after the first aging treatment step.

* * * * *